United States Patent [19]

Kessler

[11] Patent Number: 4,682,692

[45] Date of Patent: Jul. 28, 1987

[54] CARRIER WITH INDICIA MOUNTING MEANS

[76] Inventor: Milton Kessler, 6690 Harrington Ave., Youngstown, Ohio 44512

[21] Appl. No.: 856,442

[22] Filed: Apr. 22, 1986

[51] Int. Cl.[4] ..... B65D 33/00

[52] U.S. Cl. ..... 206/459; 40/17; 150/102; 190/102

[58] Field of Search ..... 40/2 R, 10 C, 10 R, 40/16, 16.2, 16.4, 16.6, 17, 18, 305, 307, 308, 312, 313, 359; 150/102–104, 109, 134; 190/102; 206/459

[56] References Cited

U.S. PATENT DOCUMENTS

| | | | |
|---|---|---|---|
| 406,758 | 7/1889 | McGee | 40/16 |
| 515,312 | 9/1893 | Hasker | 40/312 |
| 1,512,332 | 10/1924 | Goewey | 40/2 R |
| 1,897,341 | 2/1933 | Staufert | 40/10 R |
| 2,074,994 | 3/1937 | Stupell | 40/312 |
| 2,815,594 | 12/1957 | Heselov | 40/16.2 |
| 2,847,776 | 8/1958 | Robertson | 40/16 |
| 2,920,671 | 1/1960 | Siris et al. | 150/103 |
| 2,967,366 | 1/1961 | Colbert | 40/17 |
| 3,216,136 | 11/1965 | Lang | 40/17 |
| 3,415,407 | 12/1968 | Alden et al. | 206/459 |

FOREIGN PATENT DOCUMENTS

| | | | |
|---|---|---|---|
| 0005286 | of 1892 | United Kingdom | 40/16 |

*Primary Examiner*—Stephen Marcus
*Assistant Examiner*—Jimmy G. Foster
*Attorney, Agent, or Firm*—Browdy and Neimark

[57] ABSTRACT

A carry-all with indicia mounting means is disclosed. At least one wall of the carry-all includes indicia bearing region for personalizing and identifying the carry-all. Indicia mounting structure includes upper and a lower indicia securing regions for securing at least one indicia therein. Each indicia is provided with flanged regions for being received within V-shaped channels provided in the indicia securing regions. Indicia is of a semi-flexible plastic material, molded by conventional techniques.

3 Claims, 8 Drawing Figures

CARRIER WITH INDICIA MOUNTING MEANS

FIELD OF THE INVENTION

The present invention relates to containers equipped with replaceable indicia thereon; more particularly it relates to portable containers or carriers having replaceable indicia thereon useful for identifying and personalizing such carriers.

BACKGROUND OF THE INVENTION

Carriers, purses or carry-alls are available in many varieties and sizes. In many cases, such as for briefcases, suitcases, luggage, pocketbooks, children's lunch boxes, carry-alls or the like, it is desirable to identify the owner. This is done by either embossing an owner's initials or indicia directly onto the container's surface or by securing a tag with owner information to the container's handle. In some cases, especially in more recent years, pockets have been provided which are either adhesively secured to the container's exterior or sewn directly onto the container's exterior fabric, for providing a space for retaining owner information.

While these above-mentioned identifying devices and methods are appropriate for personalizing many types of carriers, none facilitates easy, quick and aesthetically pleasing interchange of one owner's identifying means with another. For example, when replacing owner information cards from pocket type information carrying devices, the pockets may wear or even tear, especially after extended use. Abrasively removing embossed initials or the like form personalized containers can become a tedious operation, sometimes destroying a container's exterior appearance.

There is also a need, particularly in conjunction with low-cost carry-alls, to provide an inexpensive and yet very noticeable types of identification indicia. These need to be made available with the carry-all in kit form so that the owner, upon purchase of the kit, can easily, simply and inexpensively insert selected conspicuous identification into suitable retention means. For example, an inexpensive molded plastic carry-all formed of a web structure is presently in common use in Europe, but this carry-all does not have any means by which the user can attach identification indicia thereto.

No personalized indicia bearing container has previously been available to allow quick, easy and aesthetically pleasing removable attachment or replacement of indicia during indicia attachment or replacement functions. There is also a great need for a carrier having large and bold replaceable indicia thereon for easy sight location by the owner thereof, especially by children or young adults.

SUMMARY OF THE INVENTION

Accordingly, it is an object of the present invention to overcome deficiencies of the prior art, such as those set forth above.

It is another object to provide for easy identification of carriers using simple and inexpensive means.

It is a further object of the present invention to provide an improved indicia bearing carrier.

It is yet another object of the present invention to provide a carrier equipped with indicia mounting means for securing indicia therein.

It is still another object of the present invention to provide an indicia bearing container or carrier having improved indicia replacement capabilities.

It is still a further object of the present invention to provide an inexpensive plastic indicia-bearing carrier manufactured at a relatively low cost.

It is yet a further object of the present invention to provide an indicia-bearing carrier which can be used by children as well as, adult owners.

Another object is to provide a kit including an inexpensive plastic carrier having indicia retaining means, together with a plurality of bold plastic molded letters for selection of the desired letter for insertion into the indicia retaining means.

Still other objects, features and attendant advantages of the present invention will become apparent to those skilled in the art from a reading of the following detailed description of embodiments thereof, taken in conjunction with the accompanying drawings, wherein

DETAILED DESCRIPTION OF PREFERRED EMBODIMENTS

Figure 1:
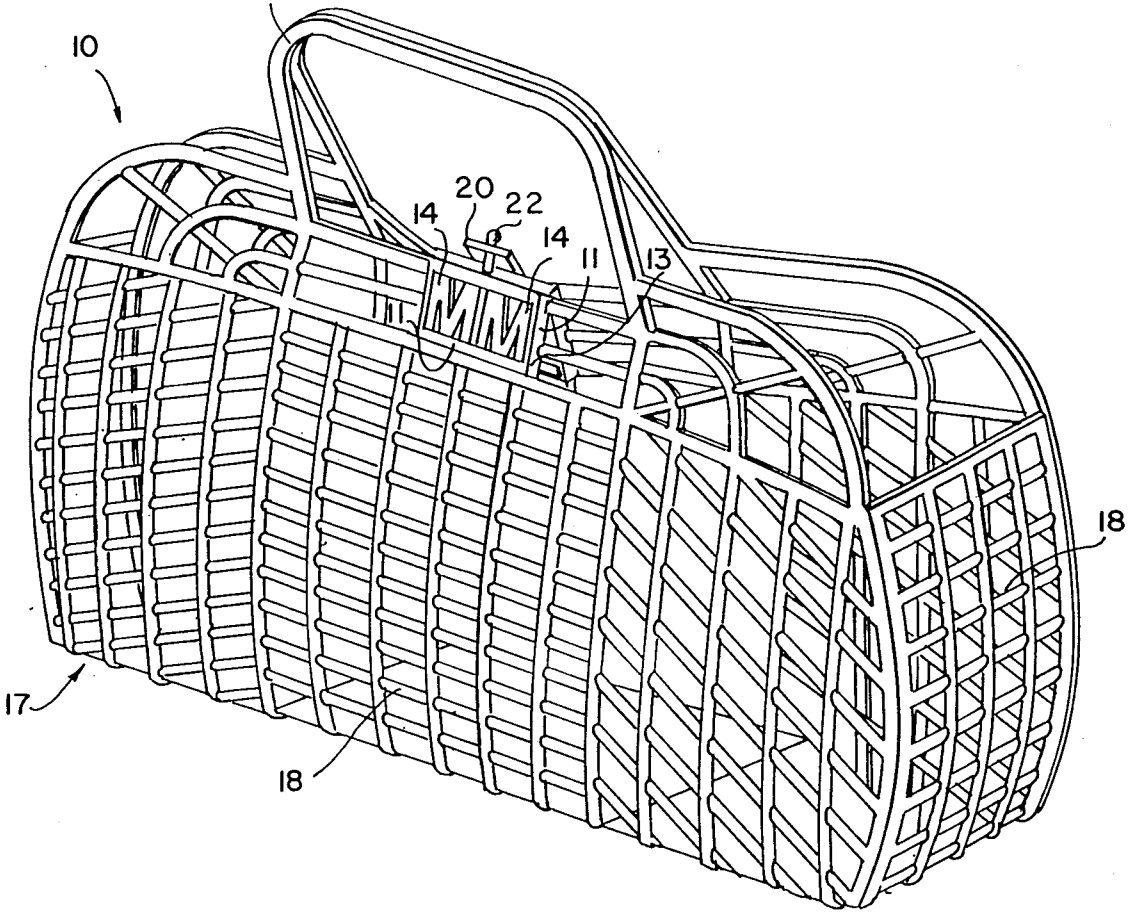
FIG. 1 is a perspective view of an embodiment of the indicia bearing carrier of the present invention.
Figure 2:
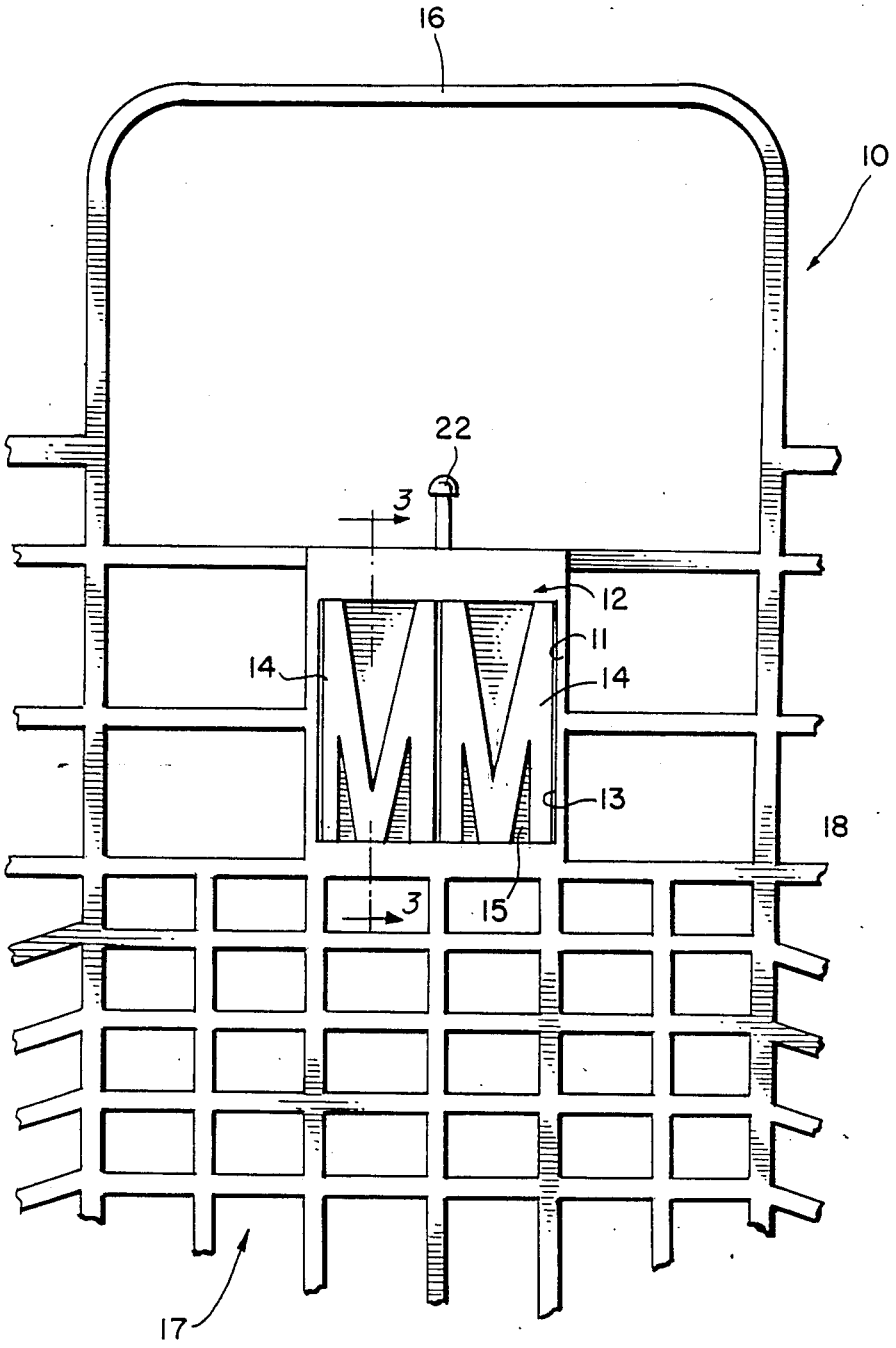
FIG. 2 is a plan view of region of the carrier of FIG. 1 bearing the indicia.

The presently preferred embodiment of the instant invention is illustrated in FIGS. 1 and 2 of the drawings and comprises the combination of a pocketbook or carry-all 10 and an indicia bearing region 12 carrying identifying indicia such as the letters 14 which may represent the owner's initials. It should be understood that the term "pocketbook" encompasses all types of carriers or carry-alls, such as briefcases, suitcases, luggage, purses or the like, particularly carry-alls for holding and carrying miscellaneous articles; the terms "pocketbook" and "carry-all" are only utilized for illustrative purposes in describing the use of the present invention.

The carry-all or pocketbook 10 includes a handle 16, fastening or latching members 20, 22, the indicia bearing region 12, and at least one wall 17. In the preferred embodiment 10, the wall 17 is formed of interconnected strands 18 formed such as by injection molding from any conventional flexible or semi-flexible plastic such as a polyolefin or vinyl plastic. Such a carry-all 10, except for the indicia bearing region 12 and its associated structure and means, is well known and commonly used in Europe.

The indicia bearing region 12, best illustrated in FIG. 2, is equipped with suitable indicia such as the letters 14,14 (letters "MM") for personalizing and identifying the pocketbook 10 with its owner. It should be understood that any indicia could be employed with the present invention, such as design, a logo or the like, and should not be limited to the single use of letter indicia.

Pocketbook 10 is provided along one surface with a recess 13 defined by a border 11 and a recessed indicia-supporting wall 15 for securing and supporting in a retained manner letter indicia 14,14. The border 11 and recessed wall 15 are integrally molded with the wall 17 and form a part of the unitary structure of the carry-all 10. Each letter 14 is preferably mounted to the indicia bearing region 12 in an upright or erect fashion as shown, with each letter having its length perpendicular to the bottom or base of the carry-all 10.

Figure 7:
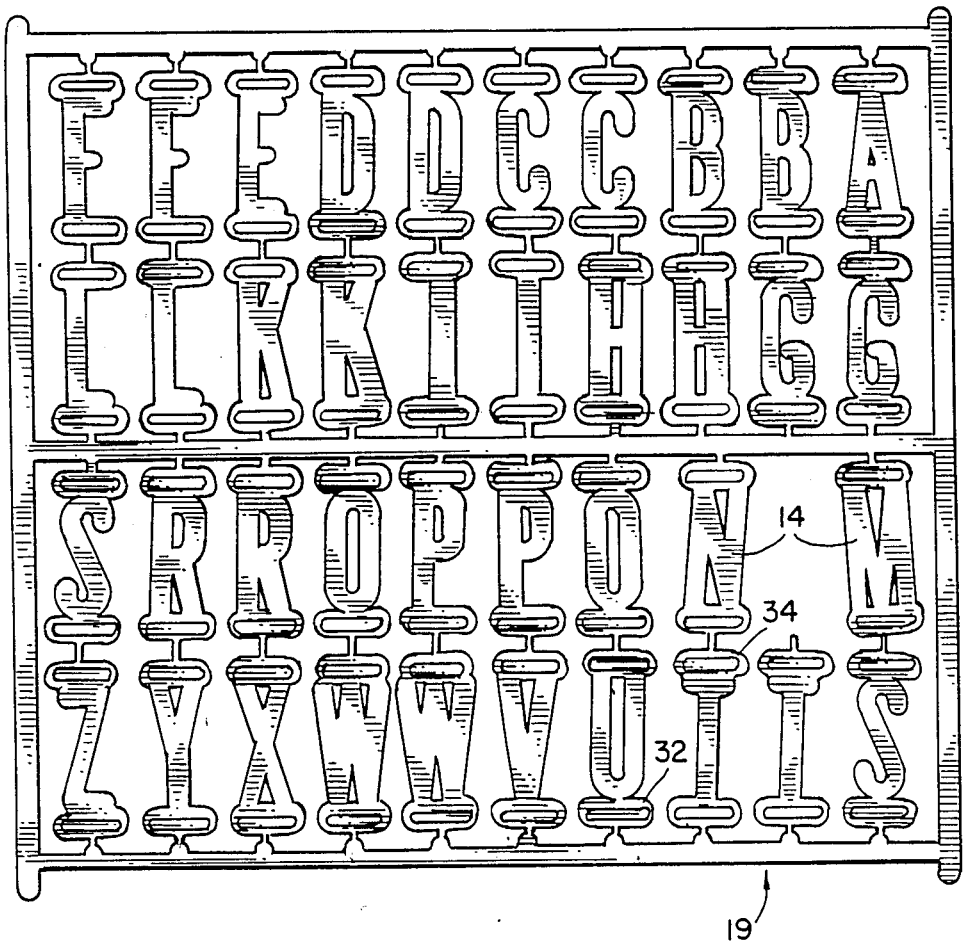
FIG. 7 is an injection molded sheet of removable letters, with an "M" removed therefrom, which forms part of the kit of the present invention.

The letter indicia 14 are preferably molded in the form of a sheet 19, as shown in FIG. 7, from any suitable semi-flexible plastic material, so as to provide each letter with enough flexibility to be mounted within securement regions of the indicia mounting means 11. A sheet 19 of letters can be sold in kit form with each carry-all 10, and the customer can then select initials from the letters 14 for placement into the indicia bearing region 12.

Pocketbook 10 is useful for carrying children's lunches as it is inexpensive to manufacture and is sturdy thus proving child worthy; for carrying recreational and other articles to and from the beach or to other recreational areas; or for the carrying of any miscellaneous articles. All pocketbooks for these uses are easily identified and personalized through the use of mounting letter indicia within the indicia mounting area 12.

Figure 3:
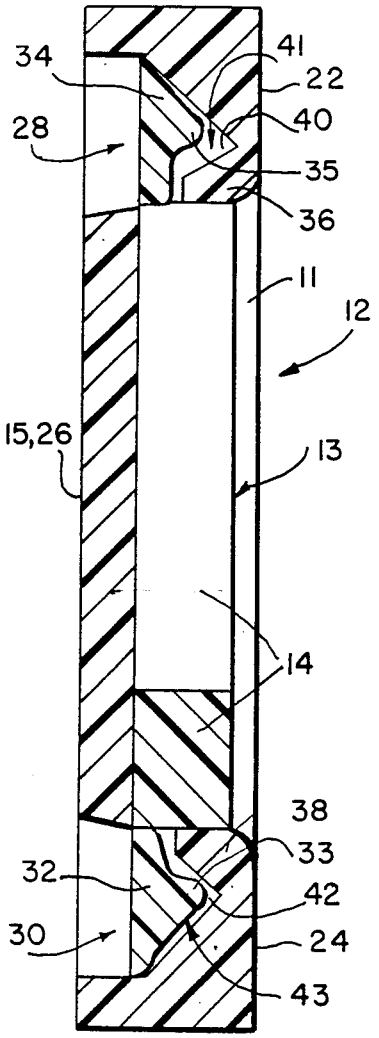
FIG. 3 is a cross-sectional view of the indicia bearing region taken along the line 3—3 in FIG. 2.
Figure 4:
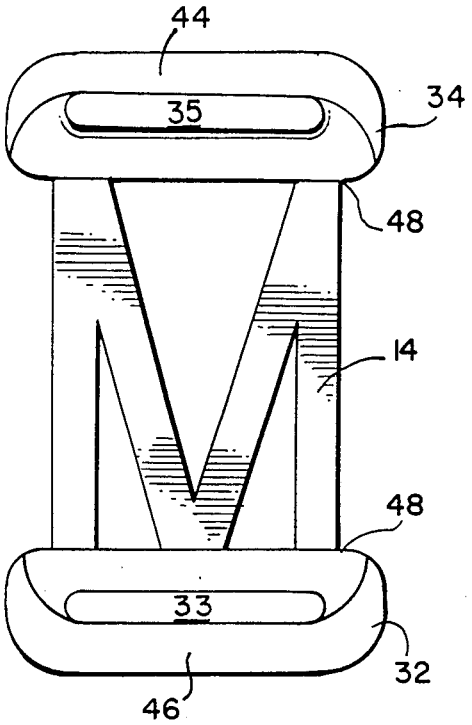
FIG. 4 is a front elevational view of a letter construction employed as an indicia segment in the use of the present invention.
Figure 5:
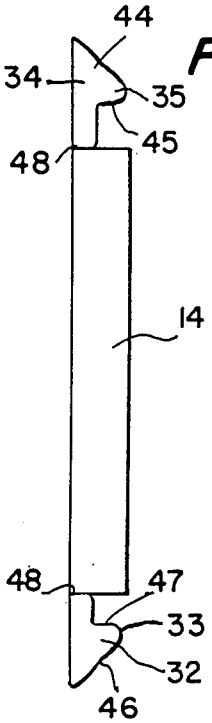
FIG. 5 is a side elevational view of the letter of FIG. 4.

Referring now to FIGS. 3, 4 and 5, indicia bearing region 12 includes as part of the frame 11 a front wall 22,24 having an opening 13 therein, a back wall 26 corresponding to the supporting wall 15 and having an upper opening 28 and a lower opening 30. Also as part of the frame or border 11 are an upper indicia securing region 40 and a lower indicia securing region 42, both securing regions being parallel to the base or bottom of the carry-all 10. The upper securing region 40 is provided with a protruding flange 36; likewise, the lower securing region 42 is provided with a protruding flange 38. As can best be seen in FIG. 3, both protruding flanges, in cross-section, form "V" shaped lower and upper channels 41,43, respectively, associated with upper and lower indicia securing means 40,42, respectively, for receiving and securing letter indicia 14.

Each letter 14 in turn has integrally molded upper and lower flanged regions 32,34 for being received within the "V" shaped channels of the indicia securing regions. Each flanged region 32,34 includes on its display side a longitudinally extending rib 33,35 which snaps, due to the flexibility of the plastic material, into the "V" shaped channels provided within the securing regions. Note that the top portions 44,46 of the flanged regions of the letters are slanted from the top of the flanged region downwardly to the top of the respective ribs 33,35. Channel abutting surfaces 45,47 (see FIG. 5) are angled more sharply than the surfaces 44,46, so that insertion into the V-shaped channels is easy because of the gently sloping surfaces 44,46 while removal is difficult because of the sharply angled surfaces 45,47. Each flanged region is connected to the letter along a line 48 (see FIGS. 4 and 5).

Figure 6A:
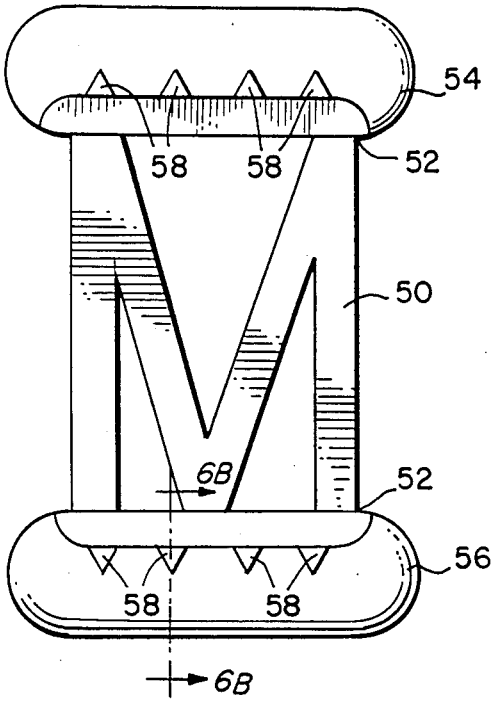
FIG. 6A is an elevational view of an alternate embodiment of a letter construction employed as an indicia segment in the use of the present invention.
Figure 6B:
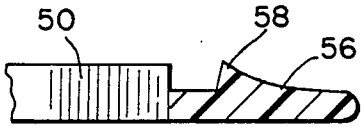
FIG. 6B is a section of same along line 6B—6B of FIG. 6A.

In an alternate embodiment, see FIGS. 6A and 6B, indicia letters 50 can include flanged regions 54 and 56 provided with a plurality of triangular or arrow-head shaped ribs 58 for being inserted within indicia securing regions 40,42.

It will be obvious to those skilled in the art that various other changes and modifications may be made without departing from the scope of the invention and the invention is not to be considered limited to what is shown in the drawings and described in the specification.

What is claimed is:

1. In a carry-all or pocketbook having at least one wall and defining an interior space for carrying miscellaneous articles, the improvement comprising:

an indicia bearing region integrally molded of flexible or semi-flexible plastic with said carry-all and forming a unitary part thereof, said indicia bearing region constituting means for removably carrying identifying indicia therein, including a recess having a back supporting wall and defined by a generally rectangular frame or border, said rectangular frame or border including opposite side walls and top and bottom walls, said top and bottom walls having interlocking means for releasably retaining upper and lower extensions of identifying indicia, said interlocking means comprising a generally V-shaped channel; and identifying indicia formed of semi-flexible plastic having retaining means including upper and lower retaining elements for mating with said V-shaped channels, said removably inserted into said recess supported by said back wall and with said retaining elements being retained within said generally V-shaped channels, said retaining elements each having a gently sloping wall permitting easy insertion into said V-shaped channels, and an opposite sharply sloping wall making removal from said V-shaped retaining channels more difficult than insertion.

2. A carry-all in accordance with claim 1 wherein said back supporting wall terminates at its upper and lower ends to define spaces opposite the generally V-shaped channels of said top and bottom walls of said frame.

3. A kit including a carry-all or pocketbook having at least one wall and defining an interior space for carrying miscellaneous articles, the carry-all further comprising an indicia bearing region integrally molded of flexible or semi-flexible plastic with said carry-all and forming a unitary part thereof, said indicia bearing region constituting means for removably carrying identifying indicia therein, including a recess having a back supporting wall and defined by a generally rectangular frame or border, said rectangular frame or border including opposite side walls and top and bottom walls, said top and bottom walls having interlocking means for releasably retaining upper and lower extensions of identifying indicia, said interlocking means each comprising a generally V-shaped channel; and a sheet of selectable indicia, each being selectively removable from said sheet, and each having upper and lower interlocking retaining means for mating with said generally V-shaped channels, said retaining means including upper and lower retaining elements for removable insertion into said recess supported by said back wall and with said retaining elements being retained within said generally V-shaped channels, said retaining elements each having a gently sloping wall permitting easy insertion into said V-shaped channels, and an opposite sharply sloping wall making removal from said V-shaped retaining channels more difficult than insertion.

* * * * *